US010934925B2

(12) United States Patent
Kim

(10) Patent No.: US 10,934,925 B2
(45) Date of Patent: Mar. 2, 2021

(54) WATER JACKET OF ENGINE

(71) Applicants: Hyundai Motor Company, Seoul (KR); Kia Motors Corporation, Seoul (KR)

(72) Inventor: Han Sang Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/660,314

(22) Filed: Oct. 22, 2019

(65) Prior Publication Data

US 2021/0003063 A1 Jan. 7, 2021

(30) Foreign Application Priority Data

Jul. 2, 2019 (KR) ..... 10-2019-0079206

(51) Int. Cl.

| | |
|---|---|
| ***F01P 7/16*** | (2006.01) |
| ***F02F 1/36*** | (2006.01) |
| ***F02F 1/14*** | (2006.01) |
| ***F02F 1/10*** | (2006.01) |
| ***F01P 7/14*** | (2006.01) |

(52) U.S. Cl.

CPC ..... *F01P 7/16* (2013.01); *F02F 1/14* (2013.01); *F02F 1/36* (2013.01); *F01P 2007/143* (2013.01); *F01P 2025/30* (2013.01); *F02F 2001/104* (2013.01)

(58) Field of Classification Search

CPC .... F01P 7/16; F01P 2007/143; F01P 2025/30; F02F 1/36; F02F 1/14; F02F 2001/104

See application file for complete search history.

(56) References Cited

U.S. PATENT DOCUMENTS

| | | | | |
|---|---|---|---|---|
| 6,279,516 | B1 * | 8/2001 | Haugen | F02F 1/38 123/41.82 A |
| 10,584,658 | B2 * | 3/2020 | Yanase | F01P 3/02 |
| 10,774,780 | B2 * | 9/2020 | Sato | F01P 3/02 |
| 2002/0124815 | A1 * | 9/2002 | Ishiguro | F02F 1/38 123/41.82 R |

(Continued)

FOREIGN PATENT DOCUMENTS

| | | | |
|---|---|---|---|
| EP | 2623759 | A1 | 8/2013 |
| EP | 3006710 | A1 | 4/2016 |

(Continued)

*Primary Examiner* — Joseph J Dallo

*Assistant Examiner* — Kurt Philip Liethen

(74) *Attorney, Agent, or Firm* — Mintz Levin Cohn Ferris Glovsky; Peter F. Corless

(57) ABSTRACT

A water jacket of an engine is capable of implementing cooling water flows as both a cross flow and a parallel flow. The water jacket includes a head water jacket formed in a cylinder head of an engine; a block water jacket formed in a cylinder block of the engine; and a variable partition wall which is configured to induce a cross flow of cooling water in a space between positions of cylinders in the head water jacket, where the variable partition wall has a shape configured to be varied according to an engine operating condition, and the variable partition wall allows the cooling water to flow in a selected one of the cross flow and a parallel flow according to the shape which is varied in head water jacket.

8 Claims, 3 Drawing Sheets

(56) References Cited

U.S. PATENT DOCUMENTS

| | | | | |
|---|---|---|---|---|
| 2004/0139933 | A1* | 7/2004 | Obermayer | F02F 1/38 123/41.82 R |
| 2009/0000578 | A1* | 1/2009 | Reustle | B22D 19/0009 123/41.82 R |
| 2009/0133647 | A1* | 5/2009 | Yamagata | F02F 1/40 123/41.82 R |
| 2015/0136380 | A1* | 5/2015 | Kim | F02N 19/10 165/253 |
| 2015/0204267 | A1* | 7/2015 | Lazich | F02F 1/36 123/193.5 |
| 2017/0268406 | A1* | 9/2017 | Lee | F02F 1/10 |
| 2018/0163608 | A1* | 6/2018 | Jang | F01P 3/02 |

FOREIGN PATENT DOCUMENTS

| | | | |
|---|---|---|---|
| KR | 100656594 | B1 | 12/2006 |
| KR | 10-2009-0102191 | A | 9/2009 |
| WO | 02/02917 | A1 | 1/2002 |
| WO | 2005/003531 | A2 | 1/2005 |
| WO | 2011/067829 | A1 | 6/2011 |

* cited by examiner

WATER JACKET OF ENGINE

CROSS-REFERENCE TO RELATED APPLICATION

This application claims under 35 U.S.C. § 119(a) the benefit of Korean Patent Application No. 10-2019-0079206 filed on Jul. 2, 2019, the entire contents of which are incorporated herein by reference.

BACKGROUND

(a) Technical Field

The present disclosure relates to a water jacket of an engine, more particularly, to the water jacket that is capable of implementing cooling water flows as both a cross flow and a parallel flow.

(b) Description of the Related Art

In a vehicle, overheating or overcooling of an engine is generally prevented using cooling water. A part of heat generated in a combustion chamber of the engine is absorbed into a cylinder head, a cylinder block, an intake valve, an exhaust valve, a piston, and the like.

However, when temperatures of these parts excessively rise, thermal deformation occurs or an oil film on an inner wall is destroyed to cause a lubrication failure phenomenon such that thermal failure may occur.

The thermal failure of the engine may generate an abnormal combustion such as a combustion failure, a knocking, or the like, and potentially cause serious damage to engine parts such as piston burning.

Further, when a temperature of the engine excessively rises, thermal efficiency and an output may be degraded. On the contrary, excessive cooling of the engine causes degradation of the output and fuel efficiency, low temperature abrasion of a cylinder, or the like such that it is necessary to always appropriately control the temperature of the engine.

In a typical engine, a water jacket is formed in a cylinder block and a cylinder head, and cooling water circulating in the water jacket cools around an ignition plug of a combustion chamber, or metal surfaces around an exhaust port and a valve seat.

In order to cool the engine, a radiator should radiate heat which is absorbed from the engine while cooling water circulates between the engine and the radiator.

That is, the radiator cools the cooling water heated in the engine, and the cooling water, which is cooled in the radiator, cools the engine again such that the temperature of the engine is controlled to an operating temperature at which an output of the engine can be optimally obtained.

In this case, the cooling water discharged from the engine can be transferred to the radiator or a heater core through a thermal management module (TMM) or an integrated thermal management system (ITM).

The TMM or the ITM may include an integrated valve device, e.g., an integrated flow control valve, for controlling a flow of the cooling water. The integrated flow rate control valve transfers the cooling water heated in the engine to the radiator to allow the cooling water to be cooled or transfers the cooling water heated in the engine to the heater core to allow the cooling water to be used for indoor heating.

The cooling water, which releases heat while passing through the radiator and the heater core, is introduced into the engine again by a water pump and continues to circulate between the engine, the radiator, and the heater core.

In addition to the above description, a system may be configured such that, while the cooling water discharged from the engine circulates by the water pump, the cooling water passes through an exhaust heat recovery system (EHRS), an automatic transmission fluid (ATF) warmer, an oil warmer, and an exhaust gas recirculation (EGR) cooler, and then is introduced into the engine.

Meanwhile, in a cooling system of the engine, a separate cooling system is known in which a flow of cooling water is achieved in each of a cylinder head and a cylinder block to improve cooling efficiency.

In the existing separate cooling system, a water jacket can be configured as shown in FIG. 1 (RELATED ART).

A water jacket 11 formed in a cylinder head (not shown) (hereinafter, referred to as a "head water jacket 11") is independently separated from a water jacket 21 formed in a cylinder block (hereinafter, referred to as a "block water jacket 21"). An inlet 22 through which cooling water flows from a water pump (not shown) toward the water jacket 11 and 21 is formed on the cylinder block such that the inlet 22 can be shared by the two water jackets 11 and 21.

Further, outlets 12 and 23 of the water jackets 11 and 21 can be independently formed in the cylinder head and the cylinder block.

Accordingly, the cooling water transferred from the water pump is separated to flow to the head water jacket 11 and the block water jacket 21 through the inlet 22. The cooling water introduced into the head water jacket 11 and the block water jacket 21 flows in an interior of each of the water jackets 11 and 21 and then is discharged through each of the outlets 12 and 23, which are independently provided on the cylinder head and the cylinder block, respectively.

The separate cooling system illustrated in FIG. 1 is a system in which a parallel flow of cooling water can be implemented in a flow of the cooling water in the water jackets 11 and 21. FIG. 2 (RELATED ART) illustrates the parallel flow of the cooling water.

In FIG. 2, a cylinder head 10 is shown in a plan shape when viewed from the top, a cylinder block 20 is shown in a front shape when viewed from the front, and circles in the cylinder head 10 indicate positions of cylinders.

As shown in FIG. 2, a plurality of cylinders are provided in the engine.

Further, although not shown in FIG. 2, since the cooling water should flow along an outer portion of a hole in which an exhaust port, an intake port, and an ignition plug are installed in each of the cylinders in the cylinder head 10, a part of a cooling water path of the head water jacket 11 in FIG. 1 is formed to be located at outer portions around the ports and the hole.

In this case, a portion in which the cooling water does not fill or flow should be present in the head water jacket 11 of the cylinder head 10 in a shape corresponding to the ports and the hole. This portion should be illustrated as being removed from FIG. 1 illustrating the head water jacket 11.

Referring to FIG. 1, the portion in which the cooling water does not fill or flow is illustrated as a hole-shaped opening 13 in the head water jacket 11.

As described above, openings 13 for installing an exhaust port, an intake port, an ignition plug are formed in each of the cylinders of the head water jacket 11.

In the cylinder block 20, the block water jacket 21 is formed to be located at an outer portion around the plurality of cylinders so as to allow the cooling water to flow along outer peripheries of the plurality of cylinders.

In the case of a parallel flow method, the cooling water flows in a direction, in which the cylinders are disposed in the head water jacket 11 of FIG. 1 in the cylinder head 10, to cool the cylinder head 10, and, in the block water jacket 21 of FIG. 1 in the cylinder block 20, a state in which the cooling water is in retention is illustrated (see FIGS. 1 and 2).

FIG. 3 (RELATED ART) is a diagram illustrating an alternative method of the separate cooling system that shows a cross flow of the cooling water.

In an engine in which a flow state of the cooling water is a cross flow, the cooling water flows to cross between the cylinders in the cylinder head 10.

In particular, when the cooling water transferred by a water pump 1 is introduced into the block water jacket 21 of FIG. 1 in the cylinder block 20 through the inlet 22, the cooling water is distributed to the head water jacket 11 of FIG. 1 and the block water jacket 21 (see FIGS. 1 and 3).

While the cooling water introduced into the head water jacket 11 moves in the direction in which the cylinders are disposed along a path of an intake side, a part of the cooling water flows to cross between positions of adjacent cylinders. In this case, the cooling water passes through a water jacket path between the positions of the adjacent cylinders.

In the case of an engine to which a cross flow method is applied, in order to prevent retention of the cooling water which does not flow in one predetermined direction, a partition wall (not shown), which is configured to guide and induce the cooling water in a direction crossing from the intake side to an exhaust side and, simultaneously, configured to act as resistance with respect to a flow of the cooling water to increase a flow speed of the cooling water which flows to cross from the intake side to the exhaust side, is provided inside a path between the positions of the adjacent cylinders in the head water jacket 11 of the cylinder head 10.

Thus, in the head water jacket 11, the cooling water exhibits a flow state of a cross flow, in which the cooling water flows to cross between the positions of the adjacent cylinder, due to the partition wall.

In this case, the cooling water introduced into the block water jacket 21 sequentially passes through peripheries of the cylinders and joins with the cooling water in the head water jacket 11. Then, the joining cooling water is discharged through the outlet 12 provided in the cylinder head 10.

Meanwhile, when separate cooling is performed in a parallel flow state in the low-speed driving section of a vehicle, a temperature on a cylinder block side is high but a temperature on a cylinder head side is low such that performance can be improved and friction can be reduced and thus fuel efficiency can be improved.

Further, in a section in which maximum performance of the engine should be achieved, e.g., in a section including rapid acceleration of a vehicle, it is advantageous that the cooling water flows in the form of a cross flow.

However, in the existing separate cooling system, the water jacket of the engine is designed and configured in only one of the parallel flow method and the cross flow method.

Accordingly, in an engine in which a flow of cooling water at a cylinder head side is a parallel flow method, a flow of the cooling water in the form of a cross flow cannot be implemented in a maximum performance implement section.

On the contrary, in an engine in which a flow of cooling water at a cylinder head side is a cross flow method, a flow of the cooling water in the form of a parallel flow cannot be implemented in a low-speed driving section of a vehicle.

The above information disclosed in this Background section is only for enhancement of understanding of the background of the disclosure and therefore it may contain information that does not form the prior art that is already known in this country to a person of ordinary skill in the art.

SUMMARY

In one aspect, the present disclosure provides a water jacket of an engine, which is capable of implementing cooling water flows as both a cross flow and a parallel flow.

In another aspect, the present disclosure provides a water jacket of an engine, which is capable of selectively implementing one of a cross flow and a parallel flow according to an engine operating condition.

In a preferred embodiment, there is provided a water jacket of an engine, which includes a head water jacket formed in a cylinder head of an engine; a block water jacket 21 formed in a cylinder block of the engine; and a partition wall which is configured to induce a cross flow of cooling water in a space between positions of cylinders in the head water jacket, wherein the partition wall has a shape configured to be varied according to an engine operating condition, and the partition wall allows the cooling water to flow in a selected one of the cross flow and a parallel flow according to the shape which is varied in head water jacket.

The engine operating condition may include a temperature of the cooling water.

The partition wall may be installed on a bottom of a cooling water path so as to allow a height of the partition wall to be varied according to the temperature of the cooling water in the space between the positions of the cylinders in the head water jacket.

In this case, the partition wall may include a wax which is expanded or contracted according to the temperature of the cooling water and of which shape is varied.

The partition wall may be installed on a bottom of a cooling water path so as to allow a height of the partition wall to be varied according to the temperature of the cooling water in the space between the positions of the cylinders in the head water jacket.

The partition wall may have a structure in which a sheathing material fixed to the bottom of the cooling water path surrounds the wax.

The sheathing material may include a material having elasticity which is deformed when the wax is expanded and is restored when the wax is contracted.

In this case, the sheathing material may include a rubber material.

Other aspects and preferred embodiments of the disclosure are discussed infra.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure, and wherein.

Figure 1:
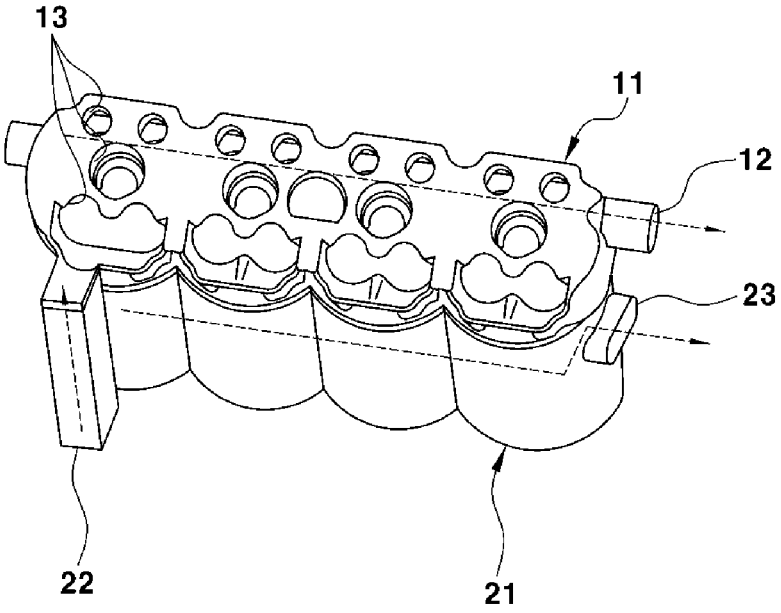
FIG. 1 (RELATED ART)
FIG. 1 (RELATED ART) is a perspective view illustrating a configuration of a known water jacket of an engine.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

Embodiments of the present disclosure will be fully described in detail below which is easily practiced by those skilled in the art to which is the present disclosure pertains with reference to the accompanying drawings. However, the present disclosure is not limited to the embodiments disclosed herein and may be implemented in other forms.

Figure 4:
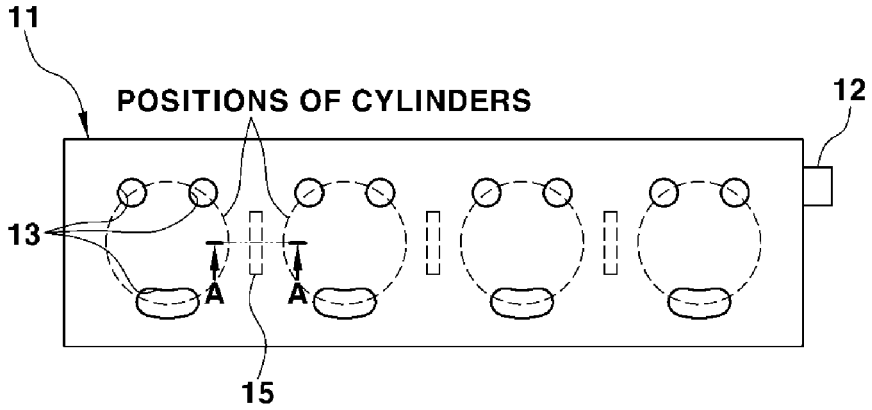
FIG. 4 is a plan view illustrating a position of a partition wall in a water jacket according to an embodiment of the present disclosure.

FIG. 4 is a diagram illustrating a water jacket according to an embodiment of the present disclosure that is a plan view illustrating a position of a partition wall in a water jacket. In particular, FIG. 4 shows a position at which a wax type partition wall for implementing a flow of cooling water in a cross flow method in a head water jacket is installed.

Figure 5:
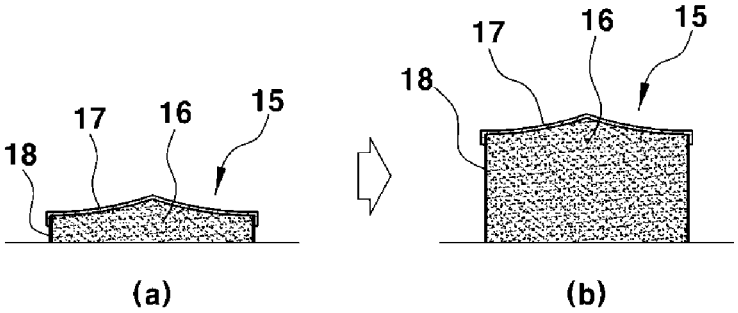
FIG. 5 is a cross-sectional view illustrating a state of a wax type partition wall according to an engine operating condition in the water jacket according to the embodiment of the present disclosure.

Further, FIG. 5 is a cross-sectional view illustrating a state of the wax type partition wall according to an engine operating condition in the water jacket according to the embodiment of the present disclosure that shows a state variation of the wax type partition wall according to a temperature of the cooling water as the engine operating condition.

In FIG. 5, (a) shows a case in which the temperature of the cooling water is low, and (b) shows a case in which the temperature of the cooling water is high.

Figure 6A:
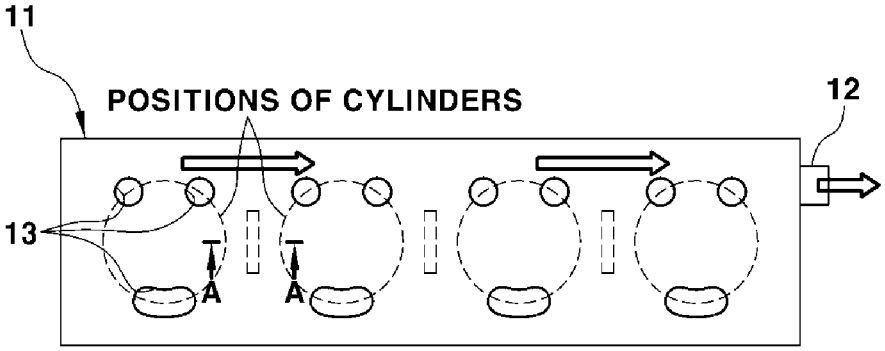
FIGS. 6A-6B are diagrams illustrating a flow state of a cooling water according to an engine operating condition in the water jacket according to the embodiment of the present disclosure.
Figure 6B:
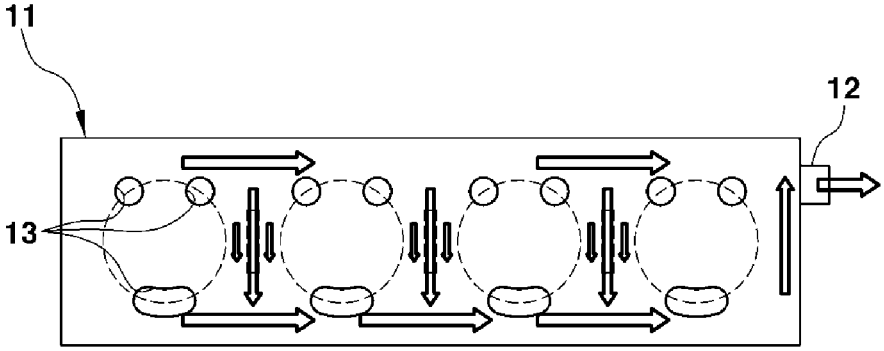

FIGS. 6A-6B are state diagrams illustrating a flow state of the cooling water according to the engine operating condition in the water jacket according to the embodiment of the present disclosure. FIG. 6A shows a state of a parallel flow of the cooling water and FIG. 6B shows a state of a cross flow of the cooling water.

When the partition wall is in a state shown in (a) of FIG. 5, the parallel flow of the cooling water shown in FIG. 6A may be implemented, and when the partition wall is in a state shown in (b) of FIG. 5, the cross flow of the cooling water shown in FIG. 6B may be implemented.

The water jacket of the engine according to the embodiment of the present disclosure may be applied to a separate cooling system in which a flow of the cooling water is separately made to each of a cylinder head (not shown) and a cylinder block (not shown).

The water jacket of an engine according to the embodiment of the present disclosure may include a water jacket 11 (hereinafter, referred to as a "head water jacket 11") formed in the cylinder head, and a water jacket (not shown) (hereinafter, referred to as a "block water jacket") formed in the cylinder block.

In the present disclosure, an example of the block water jacket may refer to the conventional block water jacket which is indicated by a reference numeral "21" in FIG. 1.

In the embodiment of the present disclosure, an inner space of the head water jacket 11 may be independently separated from that of the block water jacket (which is indicated by the reference numeral "21" in FIG. 1). In this case, the cooling water flowing in the independent inner spaces of the two water jackets 11 and 21 independently cools the cylinder head (which is indicated by a reference numeral "10" in FIGS. 2 and 3) and the cylinder block (which is indicated by a reference numeral "20" in FIGS. 2 and 3).

As described above, a configuration of the water jacket, which is capable of performing separate cooling according to the present disclosure, in particular, the configuration of the water jacket including the head water jacket and the block water jacket is not different from a configuration of a water jacket applied to the known separate cooling system.

In a typical engine, a hole in which an exhaust port, an intake port, and an ignition plug are installed is formed in a cylinder head. In the present disclosure, a part of a cooling water path of the head water jacket 11 is formed outer portions around the ports and the hole so as to allow the cooling water to flow along peripheries of the ports and the hole in each of cylinders in the cylinder head.

In this case, a portion in which the cooling water does not fill or flow should be present in the head water jacket 11 of the cylinder head in a shape corresponding to the ports and the hole. This portion should be illustrated as being removed from FIG. 4 illustrating the head water jacket 11.

Referring to FIG. 4, the portion in which the cooling water does not fill or flow is illustrated as a hole-shaped opening 13 in the head water jacket 11.

As described above, openings 13 for installing the exhaust port, the intake port, the ignition plug are formed in each of the cylinders of the head water jacket 11.

Further, in the cylinder block, the block water jacket is formed to be located at an outer portion around the plurality of cylinders so as to allow the cooling water to flow along peripheries of the plurality of cylinders.

Further, configurations of an inlet through which the cooling water is introduced and an outlet through which the cooling water is discharged in the water jacket of the engine according to the embodiment of the present disclosure may not be different from the configuration of the known water jacket.

For example, in the water jacket of the engine according to the embodiment of the present disclosure, the inlet and the outlet may be provided in the same manner as in the known parallel flow type water jacket.

Figure 2:
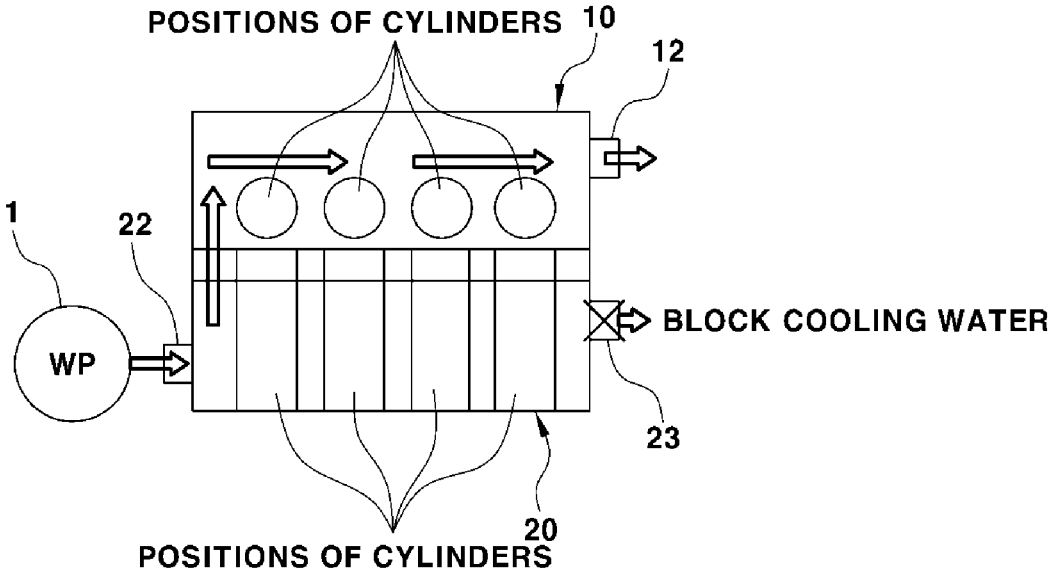
FIG. 2 (RELATED ART)
FIG. 2 (RELATED ART) is a diagram illustrating a known parallel flow of cooling water.

That is, as in the known parallel flow type water jacket illustrated in FIGS. 1 and 2, the inlet 22 through which the cooling water is introduced from the water pump (which is indicated by a reference numeral "1" in FIG. 2) to the water jacket is formed at the cylinder block 20 such that the inlet 22 may be shared by two water jackets.

Further, an outlet 12 of the water jacket may be independently formed in the cylinder head 10 and the cylinder block 20 (see FIG. 2).

Alternatively, in the water jacket of the engine according to the embodiment of the present disclosure, the inlet and the outlet may be provided in the same manner as in the known cross flow type water jacket.

Figure 3:
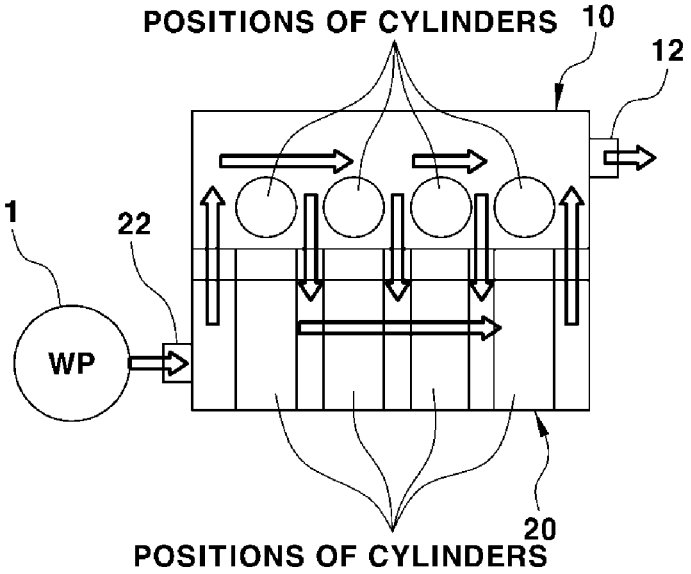
FIG. 3 (RELATED ART)
FIG. 3 (RELATED ART) is a diagram illustrating a known cross flow of the cooling water.

That is, as in the known cross flow type water jacket illustrated in FIG. 3, the inlet (which is indicated by the reference numeral "22" in FIG. 3) is formed at the cylinder block 20 such that the inlet 22 may be shared by the two water jackets, and the outlet is formed at the cylinder head 10 such that the outlet may be shared by the two water jackets (see FIG. 3).

Meanwhile, the water jacket according to the embodiment of the present disclosure is achieved by improving the configuration of the head water jacket 11. As in the conventional cross flow type water jacket, a partition wall 15 which is capable of implementing a state of a cross flow of the cooling water is provided in the head water jacket 11.

However, according to the present disclosure, the partition wall 15 in the head water jacket 11 is not a fixed type partition wall as in a related art but a variable partition wall of which shape is varied according to an engine operating condition, wherein the engine operating condition may include a temperature of the cooling water.

Further, in the water jacket according to the embodiment of the present disclosure, the block water jacket may have a configuration which is the same as that of the known block water jacket.

Thus, FIG. 4 illustrates the head water jacket 11 having a configuration which is different from that of the known water jacket, i.e., the head water jacket 11 having the variable partition wall 15 instead of the fixed partition wall as in the related art.

As shown in FIG. 4, in the present disclosure, a position at which the variable partition wall 15 is installed is between positions of two adjacent cylinders in the inner space of the head water jacket 11 in which the cooling water fills and flows. This position hasno difference when compared with an installation position of the fixed type partition wall of the related art.

That is, according to the present disclosure, the partition wall 15 for implementing the cross flow of the cooling water is located in the inner space of the head water jacket 11 in which the cooling water fills and flows. In this case, the partition wall 15 is disposed to be located between the positions of the cylinders, and an installation position of the partition wall 15 is not different from the installation position of the related art.

Referring to FIG. 5, it can be seen a state of the partition wall state according to the temperature of the cooling water as an engine operating condition. FIG. 5 (*a*) shows a case in which the temperature of the cooling water is low, and FIG. 5 (*b*) shows a case in which the temperature of the cooling water is high.

In the present disclosure, the wax-type variable partition wall 15 representing a state shown in FIG. 5 (*b*) is in a state in which the cross flow of the cooling water may be implemented in the head water jacket 11 in the cylinder head. Consequently, when compared with the state of the known partition wall, the position and a shape of the wax-type variable partition wall 15 in the head water jacket 11 may be similar to those of the known partition wall.

Further, the variable partition wall 15 showing the state of FIG. 5 (*b*) may implement the cross flow of the cooling water because the temperature of the cooling water is high. However, when the temperature of the cooling water is low and the variable partition wall 15 exhibits the state in FIG. 5 (*a*), since the variable partition wall 15 does not serve as a conventional partition wall, the head water jacket 11 in the present disclosure has no difference from a conventional head water jacket in which a partition wall is absent, i.e., a conventional parallel flow type head water jacket.

In the present disclosure, the variable partition wall 15 may be installed on a bottom of the cooling water path in the inner space of the head water jacket 11. The variable partition wall 15 may include a sheathing material 18 fixedly installed on the bottom of the cooling water path in the inner space of the head water jacket 11, and a wax 16 which fills inside the sheathing material 18 and of which shape is expanded and deformed or is contracted and restored according to a temperature.

In the embodiment of the present disclosure, the sheathing material 18 may be made of a material having elasticity and an excellent restoring force, e.g., a rubber material having a restoring force due to elasticity with a predetermined level or more after deformation.

The sheathing material 18 may be installed to be fixed to the bottom of the cooling water path of the head water jacket 11 in a state in which an inner space of the sheathing material 18 is sealed. The sealed inner space of the sheathing material 18 is filled with the wax 16.

As described above, the variable partition wall 15 has a configuration in which the sheathing material 18 surrounds an outer surface of the wax 16.

Further, in the embodiment of the present disclosure, when the variable partition wall 15 is installed on the bottom of the cooling water path of the head water jacket 11, the variable partition wall 15 should be expandable and contractable only in a vertical direction as possible.

That is, in the present disclosure, a height of the variable partition wall 15 should be variable according to the temperature of the cooling water.

To this end, a cap 17 may be installed on an upper end of the wax 16 to prevent the wax 16 from being laterally deformed. The cap 17 may be fixedly installed so as to be able to cover at least a part of a side surface of the wax 16 together with an upper surface thereof.

The cap 17 may be made of a material which is not deformed even in a condition of high-temperature cooling water, e.g., a metal plate material or a heat-resistant high-strength synthetic resin plate material which is not expanded or deformed at a high temperature and is not corroded by the cooling water.

Further, the sheathing material 18 is installed between the cap 17 and the bottom of the cooling water path of the head water jacket over an entirety of a circumference of a side surface of the cap 17. In this case, as described above, the sheathing material 18 is installed so as to be able to cover the outer surface of the wax 16.

When the temperature of the cooling water rises, the wax 16 is expanded and deformed, whereas, when the temperature of the cooling water drops, the wax 16 is contracted and restored. In the present disclosure, a wax of a known thermostat may be employed as the wax 16 of the variable partition wall 15.

When the temperature of the cooling water rises, the wax 16 is vertically gradually expanded from the bottom of the cooling water path, and, when the temperature of the cooling water reaches a temperature of a predetermined level, the wax 16 is expanded to have a shape of the variable partition wall 15 which is capable of implementing a cross flow of the cooling water.

That is, until the wax 16 has the shape of the variable partition wall 15 which is capable of implementing the cross flow of the cooling water between positions of the cylinders in the head water jacket 11, e.g., the wax 16 has the shape of the variable partition wall 15 which is similar to that of the conventional cross flow type water jacket, the wax 16 is provided to be expanded.

In particular, when the temperature of the cooling water is less than 100° C., the wax 16 cannot be sufficiently expanded to not serve as the variable partition wall 15. In this case, separate cooling in the form of a parallel flow is performed in the water jacket including the headwater jacket 11.

FIG. 6A shows a state in which the variable partition wall does not serve under a condition in which the temperature of the cooling water is low.

As shown in the drawing, in a state in which the wax 16 is not expanded to not serve as the variable partition wall 15, the flow of the cooling water is in retention in a space between positions of adjacent cylinders in the inner space of the head water jacket 11. Consequently, a flow of the cooling water crossing the space between the positions of the adjacent cylinders, i.e., a cross flow of the cooling water may not be implemented.

That is, after the cooling water introduced through the inlet flows from the block water jacket 21 to the head water jacket 11, the cooling water flows toward the outlet 12 in a parallel flow form, in which the cooling water flows only in the direction in which the cylinders are disposed, in the internal space of the head water jacket 11 and then discharged through the outlet 12.

On the contrary, when the temperature of the cooling water rises to a temperature of a predetermined level or more, e.g., when the temperature of the cooling water rises to 105° C. or more, the wax 16 may serve as the variable partition wall 15 in a state of being expanded.

In this case, while the cooling water introduced into the head water jacket 11 flows in a direction in which the cylinders are disposed along a path of the intake side, a part of the cooling water flows to cross the positions of the adjacent cylinders due to the variable partition wall 15.

In this case, the cooling water may flow in a direction from the intake side to the exhaust side in each path between the positions of the cylinders.

As described above, while the variable partition wall 15 serves, the principle in which the cooling water flows in the form of the cross flow in the head water jacket 11 has no different from the conventional cross flow water jacket.

While the wax 16 is expanded to serve as the variable partition wall 15, the cooling water flowing in the direction crossing the positions of the adjacent cylinders is guided by the variable partition wall 15. Further, the variable partition wall 15 increases a flow speed of the cooling water between the positions of the adjacent cylinders while acting as resistance on the flow of the cooling water in a parallel direction.

As described above, when the temperature of the cooling water is equal to or greater than a temperature of 105° C., the cross flow of the cooling water flow may be implemented in the water jacket such that it is possible to reduce a knocking and improve engine performance.

Therefore, in the water jacket of the engine according to the present disclosure, both of the cross flow and the parallel flow of the cooling water may be implemented. In particular, one of the cross flow and the parallel flow may be selectively implemented according to the engine operating condition such that there is advantageous to reduce a knocking and improve engine performance.

As described above, in accordance with a water jacket of an engine according to the present disclosure, both of a cross flow and a parallel flow of the cooling water can be implemented. In particular, the water jacket can be configured to selectively implement one of the cross flow and the parallel flow according to an engine operating condition such that there is advantageous to reduce a knocking and improve engine performance.

Although the embodiments of the present disclosure have been described in detail, the scope of the prevent disclosure is not limited to these embodiments, and various modifications and improvements devised by those skilled in the art using the fundamental concept of the present disclosure, which is defined by the appended claims, further fall within the scope of the present disclosure.

What is claimed is:

1. A water jacket of an engine, comprising:

a head water jacket formed in a cylinder head of an engine;

a block water jacket formed in a cylinder block of the engine; and a variable partition wall which is configured to induce a cross flow of cooling water in a space between positions of cylinders in the head water jacket, wherein the variable partition wall has a shape configured to be varied according to an engine operating condition, and the variable partition wall allows the cooling water to flow in a selected one of the cross flow and a parallel flow according to the shape which is varied in the head water jacket.

2. The water jacket of claim 1, wherein the engine operating condition includes a temperature of the cooling water.

3. The water jacket of claim 2, wherein the variable partition wall is installed on a bottom of a cooling water path so as to allow a height of the variable partition wall to be varied according to the temperature of the cooling water in the space between the positions of the cylinders in the head water jacket.

4. The water jacket of claim 2, wherein the variable partition wall includes a wax which is expanded or contracted according to the temperature of the cooling water and of which shape is varied.

5. The water jacket of claim 4, wherein the variable partition wall is installed on a bottom of a cooling water path so as to allow a height of the variable partition wall to be varied according to the temperature of the cooling water in the space between the positions of the cylinders in the head water jacket.

6. The water jacket of claim 5, wherein the variable partition wall has a structure in which a sheathing material fixed to the bottom of the cooling water path surrounds the wax.

7. The water jacket of claim 6, wherein the sheathing material includes a material having elasticity which is deformed when the wax is expanded and is restored when the wax is contracted.

8. The water jacket of claim 7, wherein the sheathing material includes a rubber material.

* * * * *